US011852390B2

(12) United States Patent
Zhou et al.

(10) Patent No.: US 11,852,390 B2
(45) Date of Patent: Dec. 26, 2023

(54) HEAT EXCHANGER, HEAT PUMP SYSTEM AND METHOD FOR HEAT EXCHANGE

(71) Applicant: Carrier Corporation, Palm Beach Gardens, FL (US)

(72) Inventors: Chunpeng Zhou, Shanghai (CN); Shuang Lu, Shanghai (CN); Guangyu Shen, Shanghai (CN); Shuguang Zhang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 507 days.

(21) Appl. No.: 17/054,380

(22) PCT Filed: Apr. 23, 2019

(86) PCT No.: PCT/US2019/028655
§ 371 (c)(1),
(2) Date: Nov. 10, 2020

(87) PCT Pub. No.: WO2019/217063
PCT Pub. Date: Nov. 14, 2019

(65) Prior Publication Data

US 2021/0215411 A1 Jul. 15, 2021

(30) Foreign Application Priority Data

May 11, 2018 (CN) ..... 201810447799.7

(51) Int. Cl.
*F25B 41/42* (2021.01)
*F25B 41/37* (2021.01)
(Continued)

(52) U.S. Cl.
CPC ..... *F25B 41/42* (2021.01); *F25B 30/02* (2013.01); *F25B 30/06* (2013.01); *F25B 39/00* (2013.01); *F25B 41/325* (2021.01); *F25B 41/37* (2021.01)

(58) Field of Classification Search
CPC ..... F25B 41/42; F25B 41/37; F25B 41/325; F25B 30/02; F25B 30/06; F25B 39/00
See application file for complete search history.

(56) References Cited

U.S. PATENT DOCUMENTS 4,057,975 A 11/1977 Del Toro et al.
4,057,977 A 11/1977 Chambless
(Continued)

FOREIGN PATENT DOCUMENTS

CN 203824169 U 9/2014
CN 104676959 A 6/2015
(Continued)

OTHER PUBLICATIONS

Pdf is original document of foreign reference WO2006083484-A1 (Year: 2006).*
(Continued)

*Primary Examiner* — Henry T Crenshaw
*Assistant Examiner* — Kamran Tavakoldavani
(74) *Attorney, Agent, or Firm* — CANTOR COLBURN LLP

(57) ABSTRACT

A heat exchanger, a heat pump system, and a heat exchange method. The heat exchanger operates in a cooling mode or a heating mode. A heat exchange medium flows through via a first flow path within the heat exchanger in the cooling mode, and flows through via a second flow path within the heat exchanger in the heating mode. A diversion component is disposed within the heat exchanger. The diversion component is configured such that the length of the first flow
(Continued)

path is different from the length of the second flow path; moreover, a partial segment of the first flow path and a partial segment of the second flow path overlap with each other, and flow directions of the heat exchange medium therein are identical.

14 Claims, 1 Drawing Sheet

(51) Int. Cl.

| | |
|---|---|
| ***F25B 41/325*** | (2021.01) |
| ***F25B 30/02*** | (2006.01) |
| ***F25B 30/06*** | (2006.01) |
| ***F25B 39/00*** | (2006.01) |

(56) References Cited

U.S. PATENT DOCUMENTS

| | | | | |
|---|---|---|---|---|
| 4,240,269 | A | 12/1980 | Bussjager | |
| 4,389,851 | A | 6/1983 | Chrostowski et al. | |
| 5,473,907 | A * | 12/1995 | Briggs | F25B 47/006 62/238.7 |
| 5,826,649 | A | 10/1998 | Chapp et al. | |
| 8,235,101 | B2 | 8/2012 | Taras et al. | |
| 9,140,474 | B2 | 9/2015 | Jang et al. | |
| 9,429,345 | B2 | 8/2016 | Kopko et al. | |
| 9,897,351 | B2 | 2/2018 | Kim et al. | |
| 2011/0056668 | A1 | 3/2011 | Taras et al. | |
| 2016/0123645 | A1 | 5/2016 | Kim et al. | |
| 2017/0167766 | A1 | 6/2017 | Jeong et al. | |

FOREIGN PATENT DOCUMENTS

| | | | | |
|---|---|---|---|---|
| JP | 2013002774 | A | 1/2013 | |
| WO | 2006083484 | A1 | 8/2006 | |
| WO | WO-2006083484 | A1 * | 8/2006 | F25B 13/00 |
| WO | 2012112802 | A1 | 8/2012 | |

OTHER PUBLICATIONS

Pdf is translation of foreign reference WO-2006083484-A1 (Year: 2006).*

International Search Report and Written Opinion for Application No. PCT/US2019/028655; dated Aug. 26, 2019; 13 Pages.

Chinese Office Action for Application No. 201810447799.7; dated Jan. 5, 2022; 10 Pages.

Lee, Yong Sang; "Flow Distribution Behavior in Condensers and Evaporators", Department of Mechanical Engineering, Korea Advanced Institute of Science and Technology; date unknown, 29 Pages, http://koasas.kaist.ac.kr/bitstream/10203/15832/1/51.pdf.

Zou, Yang; "Refrigerant Flow Distribution in Vertical Headers of Reversible Microchannel Heat Exchangers", 2014, 210 Pages, https://www.ideals.illinois.edu/bitstream/handle/2142/49521/Yang_Zou.pdf?sequence=1.

* cited by examiner

HEAT EXCHANGER, HEAT PUMP SYSTEM AND METHOD FOR HEAT EXCHANGE

CROSS-REFERENCE TO RELATED APPLICATIONS

This application is a 371 U.S. National Stage application of PCT/US2019/028655, filed Apr. 23, 2019, which claims the benefit of Chinese Application No. 201810447799.7, filed May 11, 2018, both of which are incorporated by reference in their entirety herein.

TECHNICAL FIELD

The present invention relates to the technical field of heat exchange, and in particular, to a heat exchanger, a heat pump system, and a heat exchange method.

BACKGROUND

Heat exchangers are equipment for heat exchange, and have been widely used in the industrial fields, such as petroleum, chemical industry, power, and food, as well as in people's daily life. The prior art has also provided numerous types of heat exchanger apparatuses, devices, or systems so as to meet different use demands. For example, some heat exchangers not only can operate in a cooling mode as condensers, but also can operate in a heating mode as evaporators. However, the existing heat exchangers still have defects and disadvantages in structural configuration, heat exchange effect, overall system performance, and other aspects, and can be further improved and optimized.

SUMMARY OF THE INVENTION

Accordingly, the present invention provides a heat exchanger, a heat pump system and a heat exchange method, so as to solve or at least alleviate the above problems existing in the prior art and one or more problems in other aspects.

Firstly, according to the first aspect of the present invention, a heat exchanger is provided. A heat exchange medium flows through via a first flow path in the heat exchanger when the heat exchanger operates in a cooling mode, and flows through via a second flow path in the heat exchanger when the heat exchanger operates in a heating mode. A diversion component is disposed in the heat exchanger. The diversion component is configured such that the length of the first flow path is different from the length of the second flow path. Moreover, a partial segment of the first flow path and a partial segment of the second flow path overlap with each other, and flow directions of the heat exchange medium therein are identical.

In the heat exchanger according to the present invention, optionally, an inlet end and an outlet end of the first flow path are respectively in communication with a first piping and a second piping that are connected to the heat exchanger, an inlet end and an outlet end of the second flow path are in communication with the second piping and the first piping respectively, and the diversion component includes:

one or more first heat exchange tube bundles and one or more second heat exchange tube bundles, wherein the first heat exchange tube bundle is disposed upstream of the second heat exchange tube bundle along the flow direction of the heat exchange medium in the first flow path and is in communication with the first piping, the second heat exchange tube bundle is in communication with the first piping and the second piping, a first check valve is disposed between the second heat exchange tube bundle and the first piping to prevent the heat exchange medium from flowing backward from the first piping to the second heat exchange tube bundle, and a second check valve is disposed between the second heat exchange tube bundle and the second piping to prevent the heat exchange medium from flowing backward from the second piping to the second heat exchange tube bundle;

one or more intermediate manifolds disposed between and in communication with the first heat exchange tube bundle and the second heat exchange tube bundle; and a dispenser, wherein one port of the dispenser is in communication with the second piping, a third check valve is disposed between the dispenser and the second piping to prevent the heat exchange medium from flowing backward from the dispenser to the second piping, and another port is in communication with the intermediate manifold.

In the heat exchanger according to the present invention, optionally, the number of heat exchange tubes in communication with an intermediate manifold in the first heat exchange tube bundle is greater than or equal to the number of heat exchange tubes in communication with the intermediate manifold in the second heat exchange tube bundle.

In the heat exchanger according to the present invention, optionally, each intermediate manifold is in communication with two heat exchange tubes in the first heat exchange tube bundle, and is in communication with one heat exchange tube in the second heat exchange tube bundle.

In the heat exchanger according to the present invention, optionally, at least one first manifold is disposed between the first piping and the first check valve, and the at least one first manifold is in communication with the first heat exchange tube bundle.

In the heat exchanger according to the present invention, optionally, one or more heat exchange tube bundles are further disposed between the at least one first manifold and the first heat exchange tube bundle.

In the heat exchanger according to the present invention, optionally, at least one second manifold is disposed between the second heat exchange tube bundle and the first check valve, and the at least one second manifold is in communication with the second check valve.

In the heat exchanger according to the present invention, optionally, one or more heat exchange tube bundles are further disposed between the at least one second manifold and the second heat exchange tube bundle.

In the heat exchanger according to the present invention, optionally, the other port of the dispenser is in communication with the intermediate manifold via a capillary tube.

In the heat exchanger according to the present invention, optionally, in the cooling mode, the first piping and the second piping are connected to a compressor and an evaporator respectively, and in the heating mode, the first piping and the second piping are connected to the compressor and a condenser respectively.

In the heat exchanger according to the present invention, optionally, a throttling device is disposed in the second piping, and the throttling device includes an electronic expansion valve, a thermal expansion valve, and a capillary tube.

In the heat exchanger according to the present invention, optionally, the heat exchanger is a round tube plate fin heat exchanger.

Secondly, according to the second aspect of the present invention, a heat pump system is further provided, including anyone of the heat exchangers described above.

In the heat pump system according to the present invention, optionally, the heat pump system is an air source heat pump system, and an air stream exchanges heat with a heat exchange medium flowing through the heat exchanger.

Furthermore, according to the third aspect of the present invention, a heat exchange method is further provided, including:

providing any one of the heat exchangers described above; and enabling a heat exchange medium to flow through via a first flow path in the heat exchanger, so that the heat exchanger exchanges heat when operating in a cooling mode, or enabling the heat exchange medium to flow through via a second flow path in the heat exchanger, so that the heat exchanger exchanges heat when operating in a heating mode.

The principles, characteristics, features, advantages, etc. of the technical solutions according to the present invention will be clearly understood from the following detailed description in combination with the accompanying drawings. For example, it will be appreciated that compared with the prior art, flow paths of the heat exchange medium in the cooling mode and the heating mode can be optimized according to the technical solutions designed and provided by the present invention, to achieve different lengths of the flow paths, thereby not only effectively improving flow rate control for the heat exchange medium, but also particularly enhancing the heat transfer effect significantly, reducing energy consumption, and improving the overall system performance in both the cooling mode and the heating mode. Therefore, the present invention has high applicability.

BRIEF DESCRIPTION OF THE DRAWINGS

The technical solutions of the present invention will be further illustrated in detail below in conjunction with the accompanying drawings and embodiments. However, it should be understood that the drawings are designed only for the purpose of explanation, and are only intended to conceptually illustrate the structural configurations described herein. The drawings are not necessarily drawn to scale.

DETAILED DESCRIPTION

Figure 1:
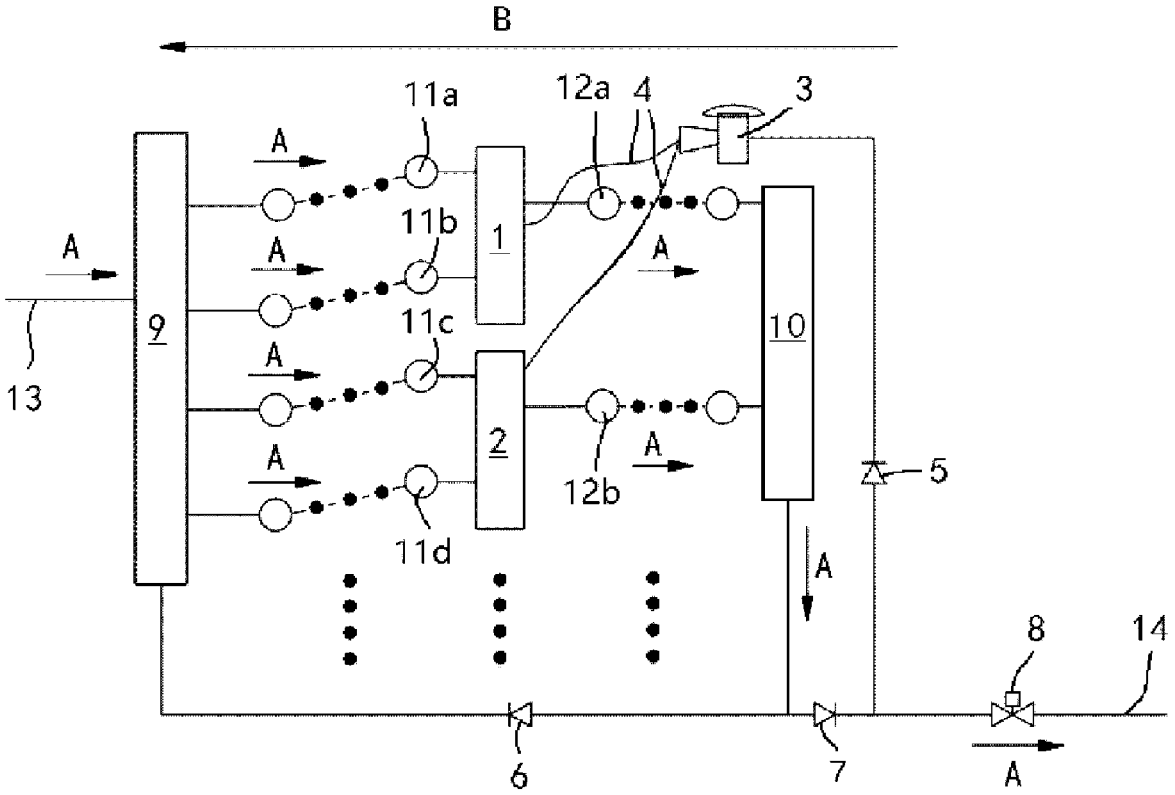
FIG. 1 is a schematic diagram depicting that an embodiment of a heat exchanger according to the present invention operates in a cooling mode.

First, it should be noted that the structural components, operating principles, steps, characteristics, advantages and the like of a heat exchanger, a heat pump system and a heat exchange method according to the present invention will be illustrated below by way of example. However, it should be understood that all descriptions are given only for the purpose of illustration, and therefore should not be construed as constituting any limit to the present invention. The technical term "communication" used herein includes not only direct intercommunication between two components, apparatuses or devices, but also intercommunication achieved by disposing one or more intermediate components, apparatuses or devices therebetween.

In addition, for any individual technical feature described or implied in the embodiments mentioned herein or any individual technical feature shown or implied in the drawings, the present invention still allows to continue any combination or deletion among these technical features (or equivalents thereof) without any technical obstacle, thereby obtaining more other embodiments of the present invention which may not be directly mentioned herein. Furthermore, for the purpose of simplifying the drawings, like or similar parts and features may be marked only at one or several places in the same figure.

The inventors of the present invention find through extensive research that the existing heat exchangers with a cooling mode and a heating mode are usually designed such that a heat exchange medium has the same flow path in the two operation modes, except that the heat exchange medium flows in opposite directions in the cooling mode and the heating mode. Since a long time ago, various types of heat exchangers have been widely used. The basic structures, components, operations, and the like of the heat exchangers have been familiar to those skilled in the art, and therefore have mostly become standard modes in the industry. Therefore, people fail to fully consider optimal designs for distinguishing the flow paths of the heat exchange medium in the heat exchanger in the cooling mode and in the heating mode to make further improvements in aspects such as enhancing the heat exchange effect, improving the system performance, saving energy, protecting the environment, and the like.

To this end, the present invention provides a novel heat exchanger having a diversion component. With the diversion component disposed in the heat exchanger, when the heat exchanger operates in the cooling mode or the heating mode, the heat exchange medium (e.g., refrigerant liquid, gas, gas-liquid mixture, or the like) can flow through heat exchange medium flow paths with different lengths in the heat exchanger in the two operation modes (i.e., a flow length of a first flow path in the cooling mode is not equal to a flow length of a second flow path in the heating mode). Moreover, a partial segment of the first flow path in the cooling mode and a partial segment of the second flow path in the heating mode overlap with each other, and a flow direction of the heat exchange medium in the partial segment of the first flow path is completely identical to that in the partial segment of the second flow path. The above technical solution of the present invention can effectively optimize flow paths of the heat exchange medium in the cooling mode and the heating mode, and in particular, the two flow paths in the two different operation modes are configured to have different flow path lengths, which will greatly help improve the overall system performance in the cooling or heating mode pertinently, so that the heat exchanger according to the present invention has prominent technical effects and performance advantages significantly superior to the existing heat exchangers.

Figure 2:
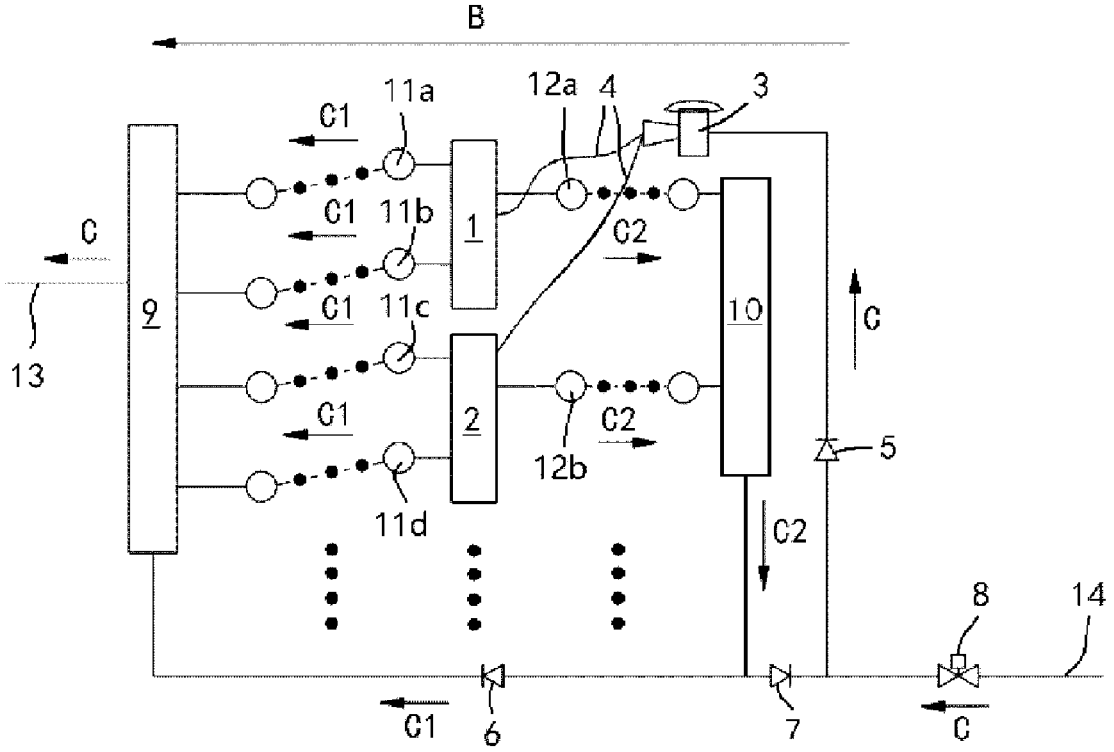
FIG. 2 is a schematic diagram depicting that the embodiment of the heat exchanger shown in FIG. 1 operates in a heating mode.

Refer to FIG. 1 and FIG. 2 below, which schematically show operation situations when an embodiment of the heat exchanger according to the present invention is in the cooling mode and the heating mode. The technical solutions of the present invention will be further illustrated in detail below with reference to this example.

First, as shown in FIG. 1, in the given embodiment of the heat exchanger, the heat exchanger is exemplarily shown to be in communication with a first piping 13 and a second piping 14 respectively (more specifically, an inlet end and an outlet end of the first flow path mentioned above are in communication with the first piping 13 and the second piping 14 respectively, and an inlet end and an outlet end of the second flow path mentioned above are in communication with the second piping 14 and the first piping 13 respectively), and a diversion component is disposed in the heat exchanger. The diversion component includes intermediate manifolds 1 and 2, a dispenser 3, first heat exchange tube bundles 11*a*, 11*b*, 11*c* and 11*d*, second heat exchange tube bundles 12*a* and 12*b*, a first check valve 6, a second check valve 7, and a third check valve 5.

Specifically, according to the actual use demand, the diversion component may have two or more heat exchange tube bundles, and may have one or more intermediate manifolds. For example, FIG. 1 exemplarily illustrates four first heat exchange tube bundles 11*a*, 11*b*, 11*c* and 11*d* and two second heat exchange tube bundles 12*a* and 12*b* disposed in the diversion component. Moreover, the two intermediate manifolds 1 and 2 are each disposed between the first heat exchange tube bundles 11*a*, 11*b*, 11*c* and 11*d* and the second heat exchange tube bundles 12*a* and 12*b*, and are in communication with the heat exchange tube bundles respectively. Furthermore, FIG. 1 also schematically shows that the first heat exchange tube bundles, the second heat exchange tube bundles, and the intermediate manifolds all have expandability.

The first heat exchange tube bundles 11*a*, 11*b*, 11*c* and 11*d* are disposed upstream of the second heat exchange tube bundles 12*a* and 12*b* along the direction as indicated by the arrow A in FIG. 1 (i.e., the flow direction of the heat exchange medium along the first flow path in the cooling mode), and the first heat exchange tube bundles 11*a*, 11*b*, 11*c* and 11*d* are in communication with the first piping 13.

The second heat exchange tube bundles 12*a* and 12*b* are in communication with the first piping 13 and the second piping 14. Moreover, the first check valve 6 is disposed between the second heat exchange tube bundles 12*a* and 12*b* and the first piping 13, so that the disposed first check valve 6 prevents the heat exchange medium from flowing backward from the first piping 13 to the second heat exchange tube bundles 12*a* and 12*b*. Moreover, the second check valve 7 is further disposed between the second heat exchange tube bundles 12*a* and 12*b* and the second piping 14, so that the disposed second check valve 7 prevents the heat exchange medium from flowing backward from the second piping 14 to the second heat exchange tube bundles 12*a* and 12*b*.

One port of the dispenser 3 is in communication with the second piping 14, and another port of the dispenser 3 may be in communication with the intermediate manifolds 1 and 2 via a communication component 4 (e.g., a capillary tube, a common piping, etc.). Moreover, the third check valve 5 is further disposed between the dispenser 3 and the second piping 14 for preventing the heat exchange medium from flowing backward from the dispenser 3 to the second piping 14.

With the above exemplary arrangement, as shown in FIG. 1, when the heat exchanger operates in the cooling mode, the heat exchange medium will flow along the direction as indicated by the arrow A in the figure. In this case, the intermediate manifolds 1 and 2 play the role of a three-way device, so that the heat exchange medium flows from heat exchange tubes in communication with the intermediate manifold 1 in the first heat exchange tube bundles 11*a* and 11*b* to a heat exchange tube in communication with the intermediate manifold 1 in the second heat exchange tube bundle 12*a* via the intermediate manifold 1, and flows from heat exchange tubes in communication with the intermediate manifold 2 in the first heat exchange tube bundles 11*c* and 11*d* to a heat exchange tube in communication with the intermediate manifold 2 in the second heat exchange tube bundle 12*b* via the intermediate manifold 2. In addition, the heat exchange medium is prevented from flowing from the intermediate manifolds 1 and 2 to the dispenser 3. That is, the heat exchange medium will bypass the dispenser 3 in this case, thereby bringing a smaller pressure drop, so as to effectively regulate and improve flow rate control for the heat exchange medium, and achieve better heat transfer performance of the system.

Furthermore, as shown in FIG. 2, when the heat exchanger operates in the heating mode, the heat exchange medium flows along the directions as indicated by the arrows C, C1 and C2 in the figure. In this case, the intermediate manifolds 1 and 2 have the functions of a dispenser, which diverts the heat exchange medium flowing from the second piping 14 to the intermediate manifold 1 (or 2) via the dispenser 3 and the communication component 4 into the first heat exchange tube bundles 11*a*, 11*b*, 11*c* and 11*d* (as indicated by the arrow C1 in FIG. 2) and the second heat exchange tube bundles 12*a* and 12*b* (as indicated by the arrow C2 in FIG. 2), i.e., in the heating mode, the heat exchange medium is diverted into a plurality of flow paths via the intermediate manifolds. In this case, the length of flow path is significantly different from the length of flow path in the cooling mode as mentioned above. Moreover, in the heating mode, the segment of flow path of the heat exchange medium as indicated by the arrow C2 in FIG. 2 actually overlaps with the corresponding segment of flow path of the heat exchange medium in FIG. 1. Furthermore, the flow direction of the heat exchange medium in the segment of flow path is also completely identical in the cooling mode or the heating mode. The above innovative optimization and improvement of the flow path of the heat exchange medium are provided to help reduce the flow pressure drop of the heat exchange medium in the heating mode, enhance the heat transfer effect of the heat exchanger, improve the system performance, and reduce energy consumption. Such arrangement and design are not considered or provided in the existing heat exchanger.

Referring to examples of the heat exchanger as shown in FIG. 1 and FIG. 2, the general structural components, operating principles, technical advantages and the like of the heat exchanger according to the present invention have been illustrated in detail above, but it should be noted that the present invention allows a variety of possible flexible designs, modifications and adjustments depending on the actual use without departing from the subject of the present invention.

For example, while the above figures show that two intermediate manifolds 1 and 2 are disposed in the diversion component of the heat exchanger, only one intermediate manifold, or three or more intermediate manifolds may be disposed in practical use, and the specific number, materials, shapes, etc. of the disposed intermediate manifolds can all be flexibly selected and configured in accordance with the design idea of the present invention. In addition, the number of heat exchange tubes disposed in the first heat exchange tube bundle, the series or parallel arrangement form between the heat exchange tubes, and the like are all allowed to be flexibly configured. Therefore, different first heat exchange tube bundles may have different numbers of ports for external connection. That is, one or some first heat exchange tube bundles may have only one port for connection with the intermediate manifold (or another component), while another or some other first heat exchange tube bundles may simultaneously use two, three or more ports for connection with the intermediate manifolds (or other components). It can be understood that the situation described above also applies to the second heat exchange tube bundle.

For another example, an exemplary embodiment schematically shows that the intermediate manifold 1 is in communication with both a heat exchange tube in the first heat exchange tube bundle 11*a* and a heat exchange tube in the first heat exchange tube bundle 11*b* on one side, and is in communication with a heat exchange tube in the second heat exchange tube bundle 12*a* and the communication component 4 on the other side, while the intermediate manifold 2 is in communication with both a heat exchange tube in the first heat exchange tube bundle 11*c* and a heat exchange tube in the first heat exchange tube bundle 11*d* on one side, and is in communication with a heat exchange tube in the second heat exchange tube bundle 12*b* and the communication component 4 on the other side. However, it should be noted that in practical use, each intermediate manifold may be in communication with one or more heat exchange tubes in the first heat exchange tube bundles, and may be in communication with one or more heat exchange tubes in the second heat exchange tube bundles. Alternatively, one intermediate manifold may be configured such that the number of heat exchange tubes in communication therewith in the first heat exchange tube bundle is greater than or equal to the number of heat exchange tubes in communication therewith in the second heat exchange tube bundle.

It can be understood that with the above flexible arrangements for the intermediate manifolds, the heat exchange tube bundles, and the like, and/or in combination with more combined configurations, e.g., a dispenser, a communication component, a check valve or other components, apparatuses, or devices, a diversion component with many implementations may be provided in numerous embodiments according to the present invention.

Furthermore, in some embodiments, it is possible to consider disposing one or more manifolds 9 additionally in the heat exchanger. For example, at least one manifold 9 can be disposed between the first piping 13 and the first check valve 6, and the manifold 9 is in communication with the first heat exchange tube bundles 11*a*, 11*b*, 11*c* and 11*d*. Furthermore, alternatively, one or more heat exchange tube bundles may be further added between the manifold 9 and the first heat exchange tube bundles 11*a*, 11*b*, 11*c* and 11*d*, to meet some actual use demands. Likewise, in some embodiments, it is further allowed to dispose one or more manifolds 10 in the heat exchanger, i.e., at least one manifold 10 can be disposed between the second heat exchange tube bundles 12*a* and 12*b* and the first check valve 6, and the manifold 10 is in communication with the second check valve 7. Moreover, according to the actual use demand, optionally, one or more heat exchange tube bundles may be further added between the manifold 10 and the second heat exchange tube bundles 12*a* and 12*b*.

Furthermore, it should be further understood that the present invention further allows connecting the first piping 13 to a compressor, and connecting the second piping 14 to an evaporator (in the cooling mode) or a condenser (in the heating mode) without departing from the subject of the present invention, thereby constructing a system achieving more uses.

Furthermore, in some optional embodiments, it is further allowed to dispose a throttling device or mechanism, e.g., a capillary tube, an electronic expansion valve, a thermal expansion valve or the like, in the second piping 14, as shown in FIG. 1 and FIG. 2, so as to regulate the flow rate of the heat exchange medium as required.

According to another technical solution of the present invention, a diversion component is further provided, in which the diversion component in the heat exchanger designed and provided according to the present invention is used, thereby achieving the significant technical advantages mentioned above. Such a diversion component has been illustrated in detail above, and details will not be described again.

Furthermore, according to still another technical solution of the present invention, a heat pump system is further provided, in which the heat exchanger designed and provided according to the present invention is disposed. Such a heat exchanger includes, but is not limited to, e.g., a round tube plate fin (RTPF) heat exchanger, so as to achieve the technical advantages of the present invention significantly superior to the prior art as mentioned above. For example, the heat pump system may be an air source heat pump system, and the air stream may exchange heat, along the direction as indicated by the arrow B in FIG. 1 and FIG. 2, with the heat exchange medium flowing through the heat exchanger (along the direction as indicated by the arrow A or the arrows C, C1 and C2).

Furthermore, according to yet another technical solution of the present invention, a heat exchange method is further provided, including the following steps:

first, providing a heat exchanger designed and provided according to the present invention;

then, enabling a heat exchange medium to flow through the heat exchanger via a first flow path in the heat exchanger, so that the heat exchanger exchanges heat when operating in a cooling mode, or enabling the heat exchange medium to flow through the heat exchanger via a second flow path in the heat exchanger, so that the heat exchanger exchanges heat when operating in a heating mode.

It can be understood that the technical contents, such as the heat exchanger according to the present invention, the flowing process of the heat exchange medium in the heat exchanger in the cooling mode or the heating mode, and optimal designs of the first flow path and the second flow path, have been illustrated in great detail above. Therefore, reference can be directly made to specific descriptions of the preceding corresponding parts, and descriptions will not be repeated here.

The heat exchanger, the heat pump system and the heat exchange method according to the present invention are illustrated in detail above by way of example only. These examples are merely provided to illustrate the principles and implementations of the present invention, rather than to limit the present invention. Those skilled in the art may further make various modifications and improvements without departing from the spirit and scope of the present invention. Therefore, all equivalent technical solutions should belong to the scope of the present invention, and be defined by the claims of the present invention.

The invention claimed is:

1. A heat exchanger, operating in a cooling mode or a heating mode, a heat exchange medium flowing through via a first flow path within the heat exchanger in the cooling mode, and flowing through via a second flow path within the heat exchanger in the heating mode, wherein a diversion component is disposed within the heat exchanger, the diversion component is configured such that the length of the first flow path is different from the length of the second flow path, a partial segment of the first flow path and a partial segment of the second flow path overlap with each other, and flow directions of the heat exchange medium therein are identical;

wherein an inlet end and an outlet end of the first flow path are respectively in communication with a first piping and a second piping that are connected to the heat exchanger, an inlet end and an outlet end of the second flow path are in communication with the second piping and the first piping respectively, and the diversion component comprises:

one or more first heat exchange tube bundles and one or more second heat exchange tube bundles, wherein the first heat exchange tube bundle is disposed upstream of the second heat exchange tube bundle along the flow direction of the heat exchange medium within the first flow path and is in communication with the first piping, the second heat exchange tube bundle is in communication with the first piping and the second piping, a first check valve is disposed between the second heat exchange tube bundle and the first piping to prevent the heat exchange medium from flowing backward from the first piping to the second heat exchange tube bundle, and a second check valve is disposed between the second heat exchange tube bundle and the second piping to prevent the heat exchange medium from flowing backward from the second piping to the second heat exchange tube bundle;

one or more intermediate manifolds disposed between and in communication with the first heat exchange tube bundle and the second heat exchange tube bundle; and a dispenser, wherein one port of the dispenser is in communication with the second piping, a third check valve is disposed between the dispenser and the second piping to prevent the heat exchange medium from flowing backward from the dispenser to the second piping, and another port is in communication with the intermediate manifold.

2. The heat exchanger according to claim 1, wherein the number of heat exchange tubes in communication with an intermediate manifold in the first heat exchange tube bundle is greater than or equal to the number of heat exchange tubes in communication with the intermediate manifold in the second heat exchange tube bundle.

3. The heat exchanger according to claim 2, wherein each intermediate manifold is in communication with two heat exchange tubes in the first heat exchange tube bundle, and is in communication with one heat exchange tube in the second heat exchange tube bundle.

4. The heat exchanger according to claim 1, wherein at least one first manifold is disposed between the first piping and the first check valve, and the at least one first manifold is in communication with the first heat exchange tube bundle.

5. The heat exchanger according to claim 4, wherein one or more heat exchange tube bundles are further disposed between the at least one first manifold and the first heat exchange tube bundle.

6. The heat exchanger according to claim 1, wherein at least one second manifold is disposed between the second heat exchange tube bundle and the first check valve, and the at least one second manifold is in communication with the second check valve.

7. The heat exchanger according to claim 6, wherein one or more heat exchange tube bundles are further disposed between the at least one second manifold and the second heat exchange tube bundle.

8. The heat exchanger according to claim 1, wherein the other port of the dispenser is in communication with the intermediate manifold via a capillary tube.

9. The heat exchanger according to claim 1, wherein in the cooling mode, the first piping and the second piping are connected to a compressor and an evaporator respectively, and in the heating mode, the first piping and the second piping are connected to the compressor and a condenser respectively.

10. The heat exchanger according to claim 1, wherein a throttling device is disposed in the second piping, and the throttling device comprises an electronic expansion valve, a thermal expansion valve, and a capillary tube.

11. The heat exchanger according to claim 1, wherein the heat exchanger is a round tube plate fin heat exchanger.

12. A heat pump system, comprising the heat exchanger according to claim 1.

13. The heat pump system according to claim 12, wherein the heat pump system is an air source heat pump system, and an air stream exchanges heat with the heat exchange medium flowing through the heat exchanger.

14. A heat exchange method, comprising:

providing the heat exchanger of claim 1; and enabling the heat exchange medium to flow through via the first flow path within the heat exchanger, so that the heat exchanger exchanges heat when operating in the cooling mode, or enabling the heat exchange medium to flow through via the second flow path within the heat exchanger, so that the heat exchanger exchanges heat when operating in the heating mode.

* * * * *